US009398993B2

(12) United States Patent
Wei et al.

(10) Patent No.: US 9,398,993 B2
(45) Date of Patent: Jul. 26, 2016

(54) TATTOO CHAIR

(71) Applicants: Wen Wei, Baldwin Park, CA (US); Michael Chen, Baldwin Park, CA (US); Billy Chen, Baldwin Park, CA (US)

(72) Inventors: Wen Wei, Baldwin Park, CA (US); Michael Chen, Baldwin Park, CA (US); Billy Chen, Baldwin Park, CA (US)

( * ) Notice: Subject to any disclaimer, the term of this patent is extended or adjusted under 35 U.S.C. 154(b) by 0 days.

(21) Appl. No.: 14/477,919

(22) Filed: Sep. 5, 2014

(65) Prior Publication Data

US 2014/0375091 A1 Dec. 25, 2014

Related U.S. Application Data

(63) Continuation of application No. 12/739,882, filed as application No. PCT/CN2008/001636 on Sep. 22, 2008, now Pat. No. 8,864,233.

(30) Foreign Application Priority Data

Oct. 31, 2007 (CN) ..... 2007 2 0195884 U

(51) Int. Cl.
*A61G 15/02* (2006.01)
*A61G 15/12* (2006.01)
(Continued)

(52) U.S. Cl.
CPC ..... *A61G 15/02* (2013.01); *A47C 1/022* (2013.01); *A47C 1/025* (2013.01); *A47C 1/06* (2013.01);
(Continued)

(58) Field of Classification Search
CPC ..... A47C 15/004; A47C 1/06; A47C 15/008; A47C 1/025; A47C 1/00; A47C 1/022; A47C 7/52; A47C 7/503; A47C 7/506; A47C 7/386; A47C 20/026; A47C 1/026; A47C 1/03205; A47C 1/03238; A47C 7/38; A47C 7/50; A47C 7/546; A47C 7/383; A61G 15/02; A61G 15/00
USPC ..... 297/354.13, 344.21, 195.11, 344.19, 297/411.28, 411.26, 423.4, 92, 94, 900, 297/377, 399, 423.36, 220, 376, 354.12, 297/411.23, 410, 397; 5/12.1; 128/845; 482/142
See application file for complete search history.

(56) References Cited

U.S. PATENT DOCUMENTS 717,026 A 12/1902 Ostendorf
1,420,924 A * 6/1922 Hogan ..... 297/411.28
(Continued)

FOREIGN PATENT DOCUMENTS

CN 2151738 1/1994
CN 300792112 6/2008
CN 201119969 9/2008

OTHER PUBLICATIONS

International Search Report of PCT/CN2008/001636 dated Nov. 27, 2008, 6 pages.

*Primary Examiner* — Milton Nelson, Jr.
(74) *Attorney, Agent, or Firm* — Rankin, Hill & Clark LLP

(57) ABSTRACT

A tattoo chair, comprises a backrest (1), a seat (2), a brace (3) for supporting the said seat (2), and a base (4) for allowing the chair to stand stably, characterized in that: the lower end of the said backrest (1) is rotatablely attached to the inner side of the said seat (2); a supporting fixed plate (5) is provided under the bottom surface of the said seat (2); at least one fixed gear rack (10) is mounted from top to bottom on the rear surface of the said backrest (1); a supporting rod (50) is provided on the said supporting fixed plate (5); one end of the said supporting rod (50) is rotatablely attached to the said supporting fixed plate (5), and the other end is put into one of grooves of the said gear rack (10) on the rear surface of the said backrest (1). The present utility model facilitates the person to be tattooed to adopt different poses, so that the tattoo artist can work more easily; further, when getting tattooed, the person will feel free and easy from any discomfort in the various poses.

10 Claims, 6 Drawing Sheets

(51) Int. Cl.

| | |
|---|---|
| ***A47C 7/54*** | (2006.01) |
| ***A47C 7/38*** | (2006.01) |
| ***A47C 7/50*** | (2006.01) |
| ***A47C 1/025*** | (2006.01) |
| ***A47C 1/06*** | (2006.01) |
| ***A47C 20/02*** | (2006.01) |
| ***A47C 7/62*** | (2006.01) |
| ***A47C 3/18*** | (2006.01) |
| ***A47C 3/30*** | (2006.01) |
| ***A47C 1/022*** | (2006.01) |
| ***A47C 15/00*** | (2006.01) |

(52) U.S. Cl.

CPC ... *A47C 3/18* (2013.01); *A47C 3/30* (2013.01); *A47C 7/38* (2013.01); *A47C 7/383* (2013.01); *A47C 7/386* (2013.01); *A47C 7/503* (2013.01); *A47C 7/506* (2013.01); *A47C 7/546* (2013.01); *A47C 15/004* (2013.01); *A47C 20/023* (2013.01); *A47C 20/026* (2013.01)

(56) References Cited

U.S. PATENT DOCUMENTS

| | | | | | |
|---|---|---|---|---|---|
| 1,699,894 | A | | 1/1929 | Klemm | |
| 1,867,600 | A | * | 7/1932 | Schwarzkopf | A47C 1/10 297/403 |
| 1,941,340 | A | | 12/1933 | Dellert | |
| 2,364,050 | A | | 12/1944 | Benson | |
| 2,687,765 | A | * | 8/1954 | Constance | 248/165 |
| 2,919,746 | A | * | 1/1960 | Nellie | A47C 1/06 297/411.4 |
| 3,220,771 | A | | 11/1965 | Doss, Sr. | |
| 3,649,074 | A | * | 3/1972 | McDonald | A47D 1/002 297/130 |
| 3,810,673 | A | * | 5/1974 | Shoji | 297/344.11 |
| 3,897,102 | A | | 7/1975 | Lemaire | |
| 4,805,928 | A | * | 2/1989 | Nakao | B62B 7/08 280/47.4 |
| 5,209,509 | A | * | 5/1993 | Gay et al. | 280/304.1 |
| 5,232,426 | A | | 8/1993 | Van Straaten | |
| 5,350,346 | A | | 9/1994 | Martinez | |
| D352,635 | S | | 11/1994 | Yoder | |
| 5,538,011 | A | | 7/1996 | Craft et al. | |
| 5,875,779 | A | | 3/1999 | Fuhrman et al. | |
| 5,926,871 | A | | 7/1999 | Howard | |
| 6,010,192 | A | * | 1/2000 | King | A47C 7/383 297/217.4 |
| 6,012,184 | A | | 1/2000 | Childers | |
| 6,446,287 | B2 | * | 9/2002 | Borders | A61G 13/0009 5/613 |
| 6,698,431 | B1 | | 3/2004 | Harris et al. | |
| 6,805,409 | B2 | | 10/2004 | Parker | |
| 6,854,807 | B2 | | 2/2005 | D'Alessandro | |
| 7,234,768 | B2 | | 6/2007 | Manning | |
| 7,431,396 | B1 | * | 10/2008 | Dasso | A47C 7/546 297/227 |
| 7,618,090 | B2 | | 11/2009 | Grenon | |
| 7,770,976 | B2 | | 8/2010 | Lee | |
| 7,963,592 | B1 | * | 6/2011 | Stanley | 297/31 |
| 2003/0011221 | A1 | * | 1/2003 | Yoshie | A47D 1/002 297/130 |
| 2007/0126202 | A1 | * | 6/2007 | Crosby | A61G 5/12 280/304.1 |

* cited by examiner

TATTOO CHAIR

CROSS-REFERENCE TO RELATED APPLICATIONS

This application is a continuation of U.S. patent application Ser. No.12/739,882 having a 371(c) date of Jul. 25, 2011, now issued as U.S. Pat. No. 8,864,233, which was a national stage entry of PCT International Application No. PCT/CN08/01636 filed on Sep. 22, 2008, both of which are expressly incorporated herein by reference.

TECHNICAL FIELD

The present invention generally relates to field of chair, and more particularly, the invention relates to a tattoo chair.

BACKGROUND

A tattoo chair is for a person who is getting tattoos to sit on. The existing tattoo chairs often comprise of a backrest, a seat, armrests, a brace and a base. Neighboring sides of the backrest and the seat are fixedly and vertically connected so that the seated person may lean against the backrest. The armrests are fixed on both sides of the seat for supporting the arms and improving the comfort. The brace is set between the seat and the base, and the seat stably stands on the ground through the brace. The obvious drawback with such known solution is that height of the brace is not adjustable, which brings inconveniences in use. Consequently, Chairs with height adjustable braces for providing different height have already been available on the market.

The existing height adjustable tattoo chairs allow a person getting tattoos to sit right toward his front. That's to say, it's convenient to tattoo the shoulder of the person, but quite inconvenient to tattoo other regularly tattooed parts of the body, such as back, belly, waist and leg etc. Furthermore, both tattoo artist and the person getting tattoos feel tired when tattooing in such inconvenient situation. Therefore, there is a need to provide a tattoo chair making it convenient to tattoo regular tattooed parts of body, and making the person getting tattoos feel comfortable while tattooing.

SUMMARY

The present utility model is to provide a tattoo chair facilitating the person getting tattoos to adopt different poses, so that the tattoo artist can work more easily; furthermore, when getting tattoos in various poses, the person will feel free and at ease without any discomfort.

To solve the technical problem described above, the present utility model adopts the following technical solution: a tattoo chair comprising a backrest, a seat, a brace for supporting the seat, and a base for allowing the chair to stand stably, wherein the lower end of the backrest is rotatablely attached to the inner side of the seat; a supporting fixed plate is provided under the bottom surface of the seat to avoid direct interaction between the brace and seat and improve wear-resistance of the seat; at least one fixed gear rack is mounted from top to bottom on the rear surface of the backrest; a supporting rod is provided on the supporting fixed plate; one end of the supporting rod is rotatablely attached to the supporting fixed plate, the other end is put into the groove of the gear rack on rear surface of the backrest; when the supporting rod is taken out of the groove of the fixed gear rack, the whole backrest can rotate around the seat; by positioning the supporting rod into different grooves of the fixed gear rack, inclination of the backrest can be adjusted; as the supporting rod is completely released, the backrest can rotate to be flush with the seat.

Further, in order to prevent the supporting rod from unexpectedly falling out of the groove of the fixed gear rack, a spring is provided between the lower part of inner side of the seat and the supporting rod.

Further, the brace is a hydraulic lifting device with its height adjusted via a pedal; the supporting fixed plate can rotate 360 degrees around the axis of the hydraulic lifting device. This configuration facilitates the person getting tattoos to bestride the tattoo chair, and it is convenient to tattoo the upper part of the person's back by lowering the height of the brace and tattoo the waist by raising the height of the brace.

As a further improvement to the above technical solution, the armrests are provided on left, right, or both sides of the seat and the backrest. Snap spring holes are provided in the seat and the backrest; fixing axes are provided on sides of both ends of the armrests to match the snap spring holes. Grooves for positioning are provided on the fixing axes to match the snap springs in the snap spring holes; thus, the fixing axes can be inserted into or taken out of the snap spring holes; this structure makes the person with his/her arms getting tattoos feel more comfortable.

As a further improvement to the technical solution, a headrest is provided on top of the backrest; a fixing axis with grooves is provided at bottom of the headrest; a snap spring hole is provided on the upper surface of the backrest to match the fixing axis such that the headrest can be either mounted on or taken away from the backrest, and the headrest is more applicable for a tall person getting tattoos.

As a further improvement to the technical solution described above, an arc hole is provided in the center of the headrest for the person getting tattoos to locate his/her face in it when he/she faces right toward the headrest.

As a further improvement to the technical solution described above, a cushion is provided on the surface of the headrest, and the cushion is connected with the headrest through a velcro tape so that the cushion can be mounted and detached easily; the cushion makes the person getting tattoos feel more comfortable when leaning his/her head against the cushion.

As a further improvement of the technical solution described above, a leg rest is provided in the front of the seat, and the leg rest is rotatablely attached to the seat. Leg rest supporting rods are provided on the rear surface of the leg rest, and a leg rest fixing brace is provided on the supporting fixed plate under the seat. The leg rest supporting rods are movably connected with the leg rest fixing brace. By adjusting the position of the leg rest supporting rods on the leg rest fixing brace, the inclination of the leg rest can be changed. The leg rest of the present utility model may be adjusted from horizontal position to vertical position. This configuration makes it quite convenient to tattoo the leg of the person getting tattoos.

As a further improvement to the technical solution described above, the leg rest is a symmetrically separate structure comprising a left leg rest and a right leg rest each having a leg rest supporting rod; a left and a right leg rest fixing braces are mounted on the supporting fixed plate to match the left and the right leg rest supporting rods respectively. The separate structure allows adjusting the left and right leg rests respectively. This configuration allows for adjusting the position of each leg of the person getting tattoos when he/she is sitting right toward the front or lying on one's back, if needed.

As a further improvement to the technical solution, a position-matched leg rest extension is provided on the lower end of the leg rest, where a snap spring holes are provided. Fixing axes with grooves are provided on the side of the leg rest extension connected to the leg rest. The fixing axes can be inserted into the snap spring holes in the lower end of the leg rest so as to connect the leg rest extension to the leg rest. The fixing axes on the leg rest extension can also be pulled out of the snap spring holes to take the leg rest extension away from the leg rest. This extension structure is more applicable for a tall person having long legs to get tattoos.

The present utility model allows the person getting tattoos to adopt different poses so that the tattoo artist can work more easily. Further, when getting tattoos, the person will feel free and at ease without any discomfort in various poses.

BRIEF DESCRIPTION OF THE DRAWINGS

The present utility model may be best understood with reference to the following detailed description, taken in connection with the accompanying drawings, in which.

DETAILED DESCRIPTION

Embodiment 1

Figure 1:
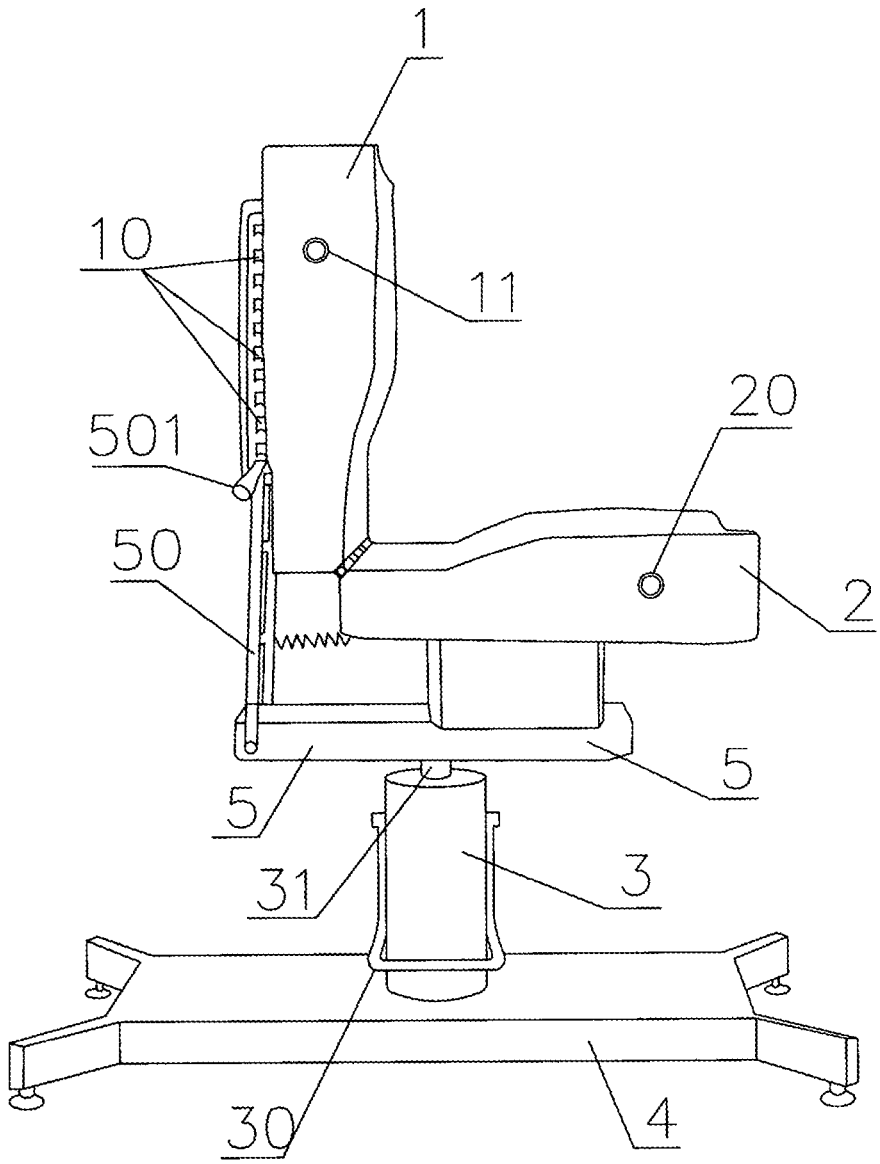
FIG. 1 is a side perspective view of the structure according to a specific embodiment of the present utility model.
Figure 2:
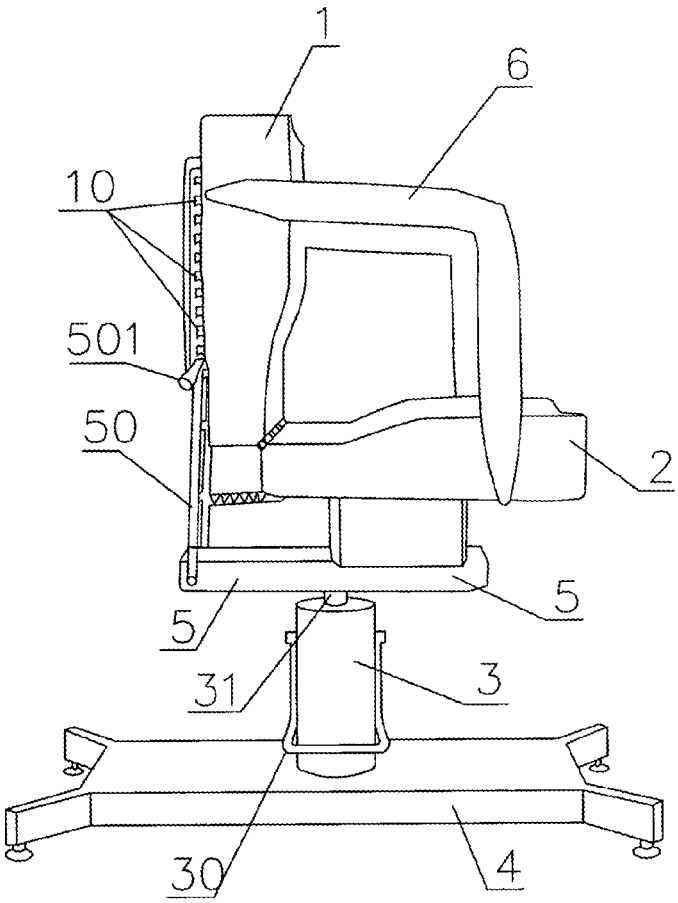
FIG. 2 is a side perspective view of the structure according to another specific embodiment of the present utility model.
Figure 3:
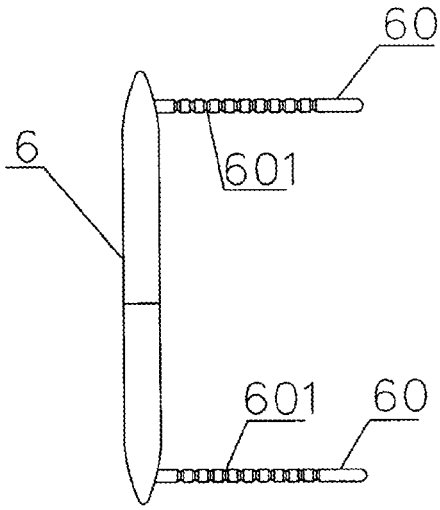
FIG. 3 is a front view of the armrest of the present utility model.
Figure 4:
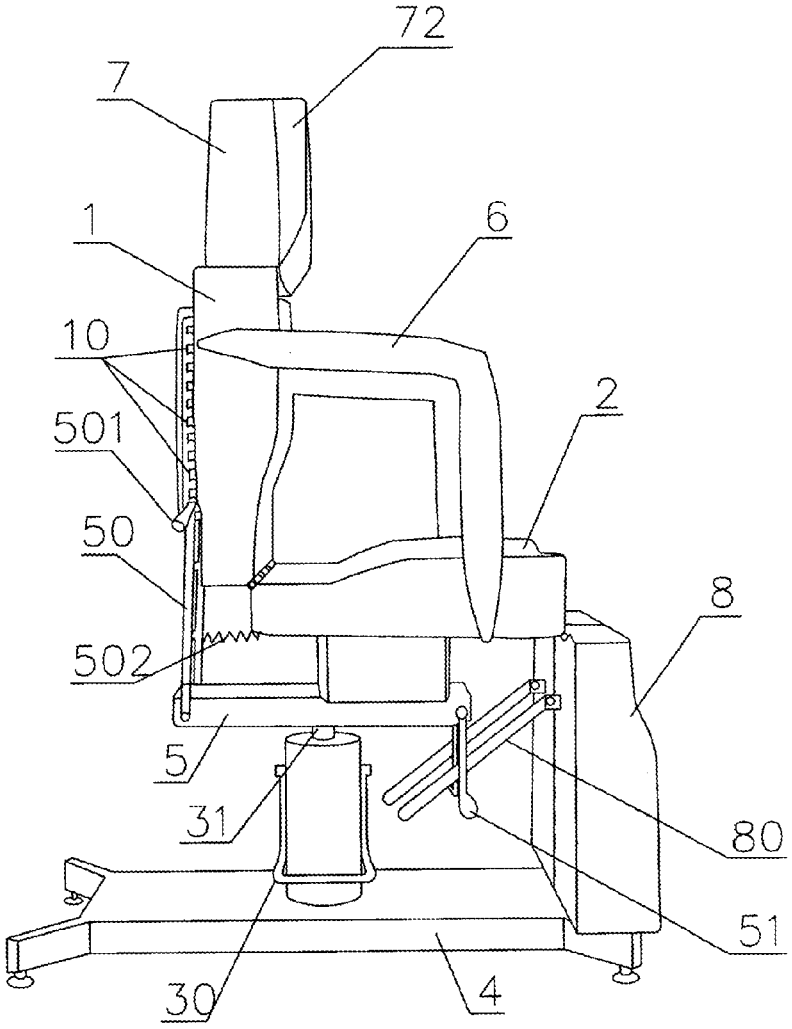
FIG. 4 is a side perspective view of the structure according to still another specific embodiment of the present utility model.

Referring to FIGS. 1, 2, 4, 6, 7 and 8, the tattoo chair comprises the backrest 1, seat 2, brace 3 for supporting the seat 2, and base 4 for allowing the chair stand stably.

The inner side of the lower end of the backrest 1 is rotatablely attached to the inner side of the seat 2 through a hinge. The seat 2 is fixed, and the backrest 1 can rotate around the inner side of the seat 2. The backrest 1 can rotate anticlockwise 90 degrees at most, that is, the backrest 1 can at lowest be flush with the seat 2. A supporting fixed plate 5 is provided under the bottom surface of the seat 2 to avoid direct contact between the brace 3 and seat 2 and improve the wear-resistance of the seat 2. A fixed gear rack 10 is mounted from top to bottom on the rear surface of the backrest 1, and one or more the racks may be mounted in longitudinal direction; a supporting rod 50, for example in a Π-shape, is attached to the supporting fixed plate 5; the left and right lower ends of the supporting rod 50 are rotatablely attached to the supporting fixed plate 5, while the upper cross rod 501 is put into the groove of the gear rack 10 on the rear surface of the backrest 1. When the cross rod 501 of the supporting rod 50 is taken out of the groove of the fixed gear rack 10, the whole backrest 1 can rotate around the seat 2. By positioning the cross rod 501 of the supporting rod 50 on the fixed gear rack 10, the inclination of backrest 1 can be adjusted. As the supporting rod 50 is completely released, the backrest 1 can rotate to be flush with the seat 2.

Referring to FIGS. 1, 2, 4 and 8, further, in order to prevent the supporting rod 50 from unexpectedly falling out of the groove of the fixed gear rack 10, a spring 502 is provided between the lower part of inner side of the seat 2 and middle part of the supporting rod 50.

Referring to FIGS. 1, 2, 4, 6, 7 and 8, further, the brace 3 is a hydraulic lifting device with its height adjusted via a pedal 30. The supporting fixed plate 5 can rotate 360 degrees around the axis 31 of the hydraulic lifting device 3. This configuration facilitates the person getting tattoos to bestride the tattoo chair. The upper part of a person's back can be tattooed conveniently by lowering the height of the brace 3, and the waist of a person can be tattooed conveniently by raising the height of the brace 3.

Referring to FIGS. 2, 3, 4, 6, 7 and 8, in accordance with the further improved embodiment, armrests 6 are provided on the left, right, or both sides of the seat 2 and backrest 1. Snap spring holes 20, 11 are provided in the seat 2 and backrest 1. Fixing axes 60 are provided on the side of both ends of the armrests 6 to match the snap spring holes 20, 11, and grooves 601 for positioning are provided on the fixing axes 60 to match the snap springs in the snap spring holes 20, 11 so that the fixing axes 60 can be inserted into or taken out of the snap spring holes 20, 11. This configuration makes the person getting tattoos on his/her arms feel more comfortable.

Referring to FIGS. 4, 5, 6, 7 and 8, in accordance with the further improved embodiment, an easily mounted and detached headrest 7 is provided on the top of the backrest 1. A fixing axis 70 with grooves 701 is provided at the bottom of the headrest 7. A snap spring hole (not shown) is provided on the upper surface of the backrest 1 to match the fixing axis 70. Thus, the headrest 7 can be either mounted onto or taken away from the backrest 1. The headrest 7 is more applicable for a tall person getting tattoos.

Figure 5:
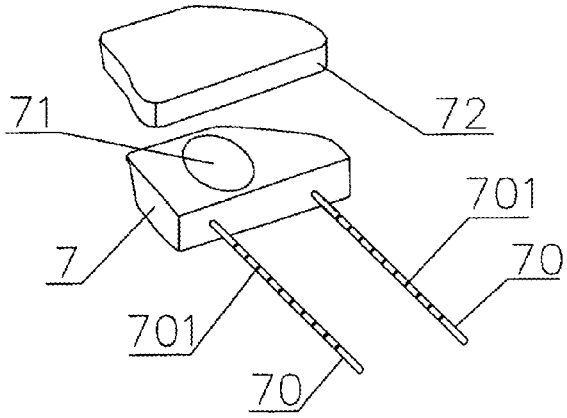
FIG. 5 is a perspective view of the structure of the headrest of the present utility model.

Referring to FIG. 5, in accordance with the further improved embodiment, an arc hole 71, preferably having a shape matching a face, is provided in the center of the headrest 7 for the person getting tattoos to locate his/her face when bestriding the tattoo chair.

Referring to FIGS. 4, 5, 6, 7 and 8, in accordance with the further improved embodiment, a cushion 72 is provided on the surface of the headrest 7, and the cushion 72 is connected with the headrest 7 through a velcro tape so that the cushion can be mounted and detached easily. The cushion 72 makes the person getting tattoos feel more comfortable when his/her head leans against the cushion.

Referring to FIGS. 4, 6, 7 and 8, in accordance with the further improved embodiment, a leg rest 8 is provided in the front of the seat 2. The leg rest 8 is rotatablely attached to the seat 2 through hinges. While the seat 2 is fixed, the leg rest 8 can rotate around the seat 2 clockwise from horizontal position. Leg rest supporting rods 80 are provided on the rear surface of the leg rest 8. A leg rest fixing brace 51 is mounted on the supporting fixed plate 5 under the seat 2. The leg rest supporting rods 80 are movably connected with the leg rest fixing brace 51. By adjusting the position of the leg rest supporting rods 80 with regard to the leg rest fixing brace 51, the inclination of the leg rest 8 with regard to the horizontal plane can be adjusted. The leg rest 8 can rotate around the seat 2 from horizontal position to vertical position. This configuration makes it quite convenient to tattoo the leg of the person.

Figure 7:
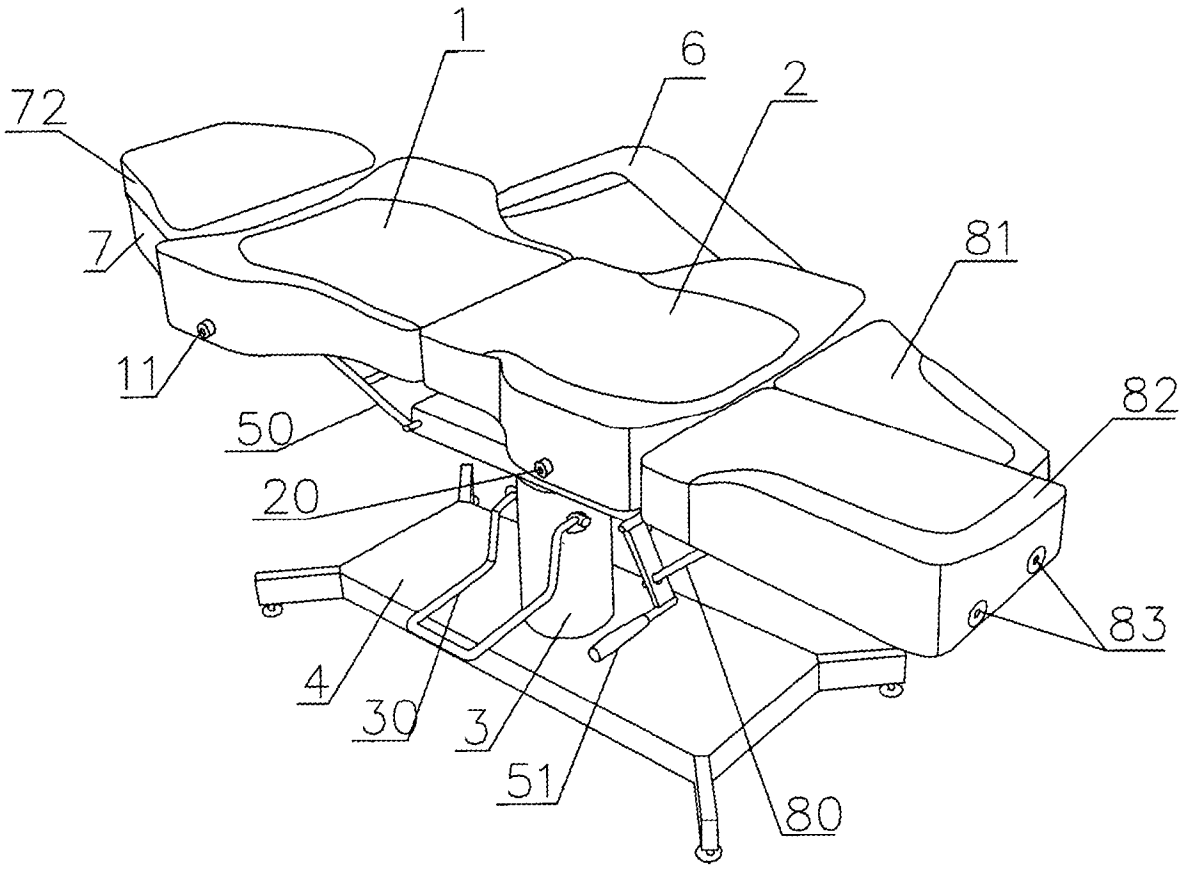
FIG. 7 is a perspective view of the state in use according to a specific embodiment of the present utility model.

Referring to FIG. 7, in accordance with the further improved embodiment, the leg rest 8 is a symmetrically separate structure comprising a left leg rest 81 and a right leg rest 82, each having a leg rest supporting rod 80. The left and the right leg rest fixing braces 51 are mounted on the supporting fixed plate 5 to match the supporting rods 80 of the left and right leg rests 81, 82, respectively. The separate structure allows adjusting the left and the right leg rests 81, 82 respectively. This configuration allows for adjusting the position of each leg of the person getting tattoos, if needed, when he/she is sitting or lying on his/her back.

Figure 6:
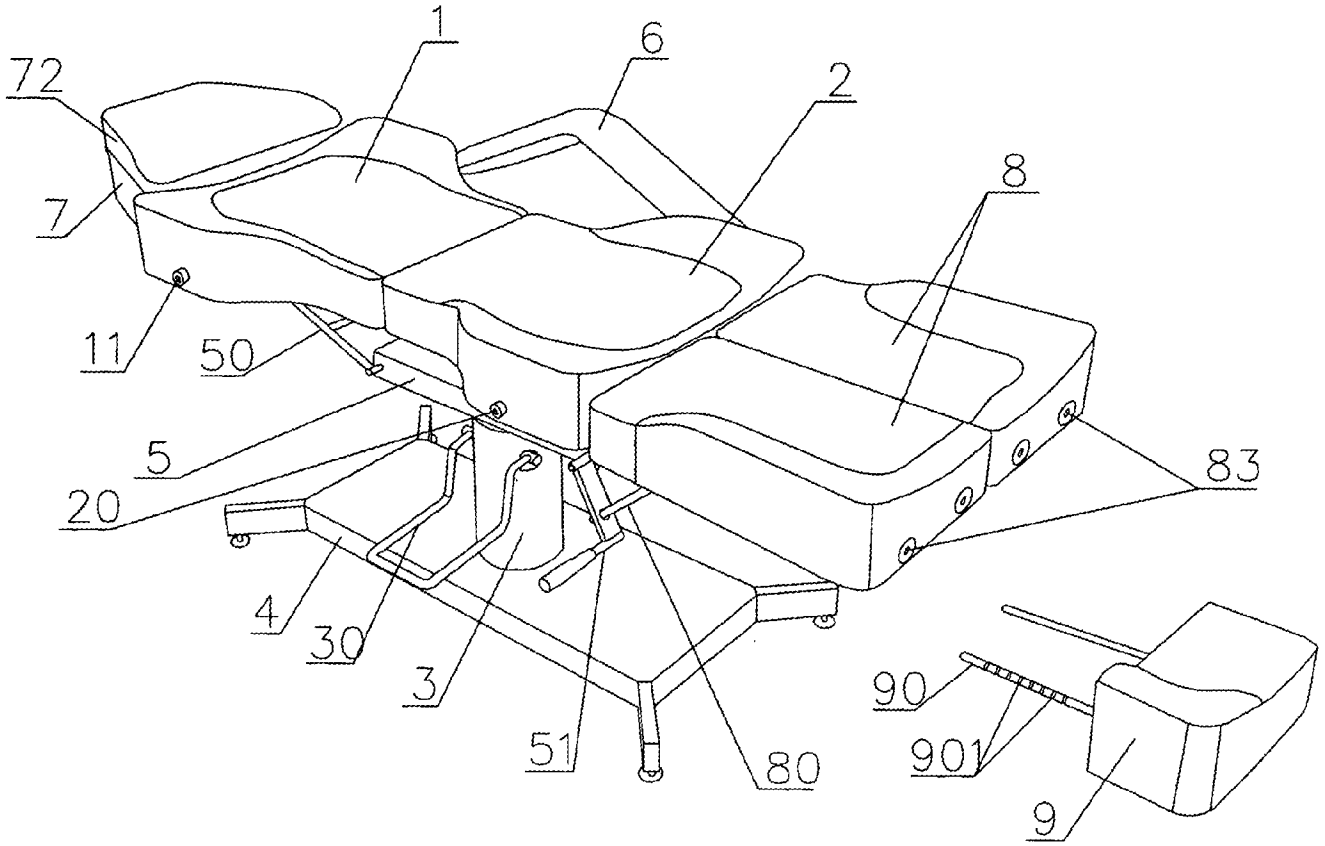
FIG. 6 is a perspective view of the structure according to yet another specific embodiment of the present utility model.
Figure 8:
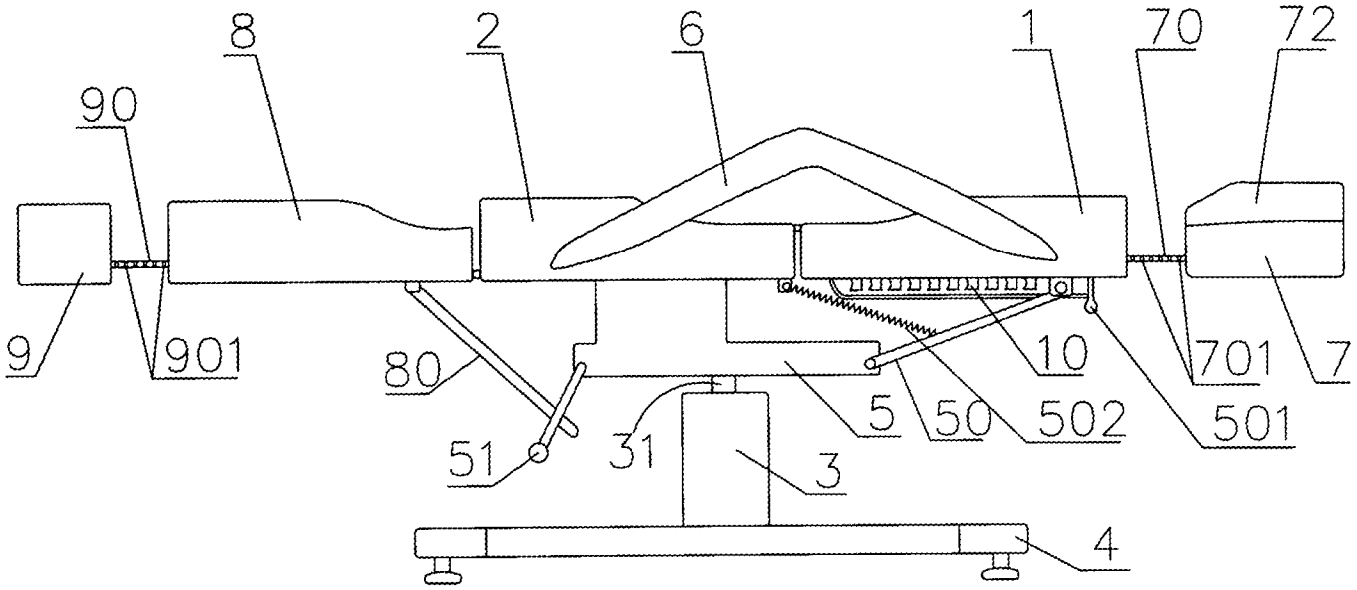
FIG. 8 is a perspective view of the structure according to a specific embodiment of the present utility model.

Referring to FIGS. 6 and 8, in accordance with the further improved embodiment, a position-matched leg rest extension 9 is provided on the lower end of the leg rest 8, where snap spring holes 83 are provided. Fixing axes 90 with grooves 901 are provided on the side of the leg rest extension 9 connected to the leg rest 8. The fixing axes 90 can be inserted into the snap spring holes 83 in the lower end of the leg rest 8 to connect the leg rest extension 9 to the leg rest 8. The fixing axes 90 on the leg rest extension 9 can also be pulled out of the snap spring holes 83 to take the leg rest extension 9 away from the leg rest 8. This extension structure is more applicable for a tall person having long legs to get tattoos.

Obviously, the embodiments described above are provided for purpose of clear explanation but not for limiting the present utility model. In fact, it will be appreciated to those skilled in the art that various modifications and variations may be made in the present utility model without departing from the spirit or scope of the utility model. Accordingly, any apparent alteration or modification derived from the technical solution of the present utility model will be in the scope of protection of the present utility model.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An adjustable tattoo chair, comprising:

a seat base rotatably supported in an elevated position such that the seat base is rotatable about a vertical axis;

a seat back extending from the seat base and pivotally movable relative to the seat base between an upright position and a generally horizontal position;

a hydraulic lifting device adjustably supporting the seat base at a desired height;

a narrowed portion tapering laterally inwardly defined on at least one of the seat base and the seat back adjacent the other of said at least one of the seat base and the seat back for facilitating straddling of the tattoo chair, wherein the narrowed portion is sized and configured to permit straddling of the chair including contact with lateral edges of the narrowed portion;

arm rests removably connected to each of the seat base and the seat back at lateral sides of the seat base and the seat back; and leg rests removably and rotatably connected to the seat base at an end thereof opposite an end to which the seat back is pivotally connected.

2. The chair of claim 1 further including leg rest extensions removably connected to ends of the leg rests opposites ends that are connected to the seat base.

3. The chair of claim 2 further including a headrest removably connected to the seat back, the headrest including a main body having a face recess defined therein and a pillow cover removably secured to the main body to selectively cover the face recess and present the headrest without the face recess.

4. The chair of claim 3 further including:

a rack gear mounted on a rear side of the seat back; and a supporting rod having a proximal end pivotally connected to the seat base and a free end configured to removably engage the rack gear for securing the seat back at a desired angle of inclination between the upright position and the horizontal position.

5. The chair of claim 4 further including:

a rack bar cage member secured to the seat back and extending along a longitudinal length of the rack gear, the rack bar cage member spaced apart a short distance from the rack gear along a longitudinal length thereof to allow for adjustment of the free end along the rack gear while preventing the free end from disconnecting from the seat back.

6. The chair of claim 4 wherein the free end of the supporting rod is urged into engagement with the rack gear by a biasing member.

7. An adjustable tattoo chair, comprising:

a seat base rotatably supported in an elevated position;

a seat back extending from the seat base and pivotally movable relative to the seat base between an upright position and a generally horizontal position, a tapered narrowed portion defined on at least one of the seat base and the seat back adjacent the other of said at least one of the seat base and the seat back for facilitating straddling of the tattoo chair, wherein the narrowed portion is sized and configured to permit straddling of the chair;

leg rests removably and rotatably connected to the seat base at an end thereof opposite an end to which the seat back is pivotally connected, and a headrest removably connected to the seat back, the headrest including a main body having a face recess defined therein and a pillow removably secured to the main body for selectively covering the face recess.

8. The chair of claim 7 further including leg rest extensions removably connected to ends of the leg rests opposites ends that are connected to the seat base.

9. An adjustable tattoo chair, comprising:

a seat base;

a seat back extending from the seat base and pivotally movable relative to the seat base between an upright position and a generally horizontal position;

a tapered narrowed portion defined on at least one of the seat base and the seat back adjacent the other of said at least one of the seat base and the seat back for facilitating straddling of the tattoo chair, wherein the narrowed portion is sized and configured to permit straddling of the chair;

a headrest removably secured to an upper end of the seat back via at least one post received into the seat back, the head rest including a main body portion having a recess disposed in a front side thereof and a plush cover member removably disposed over the recess to hide the recess, the seat back having an upper side configured to have an occupant's arms rest thereon when straddling the seat base and facing the seat back with the headrest removed from the seat back, and a pair of leg rests extending from the seat base at an end thereof that is distal relative to the seat back.

10. The chair of claim 9 further including:

a pair of leg rest extensions each respectively extending from the pair of leg rests at an end distal relative to the seat base, the pair of leg rest extensions removably attached to the pair of leg rests to enable the leg rests to fold down to an angle approximately normal relative to the seat base to facilitate access to an occupant when in a straddle position on the seat base.

* * * * *